US005133668A

United States Patent [19]

Brown, IV

[11] Patent Number: 5,133,668

[45] Date of Patent: Jul. 28, 1992

[54] ELECTRICAL CONNECTOR APPARATUS

[76] Inventor: David C. Brown, IV, 12640 Equestrian Cir., #1910, Fort Myers, Fla. 33907

[21] Appl. No.: 716,385

[22] Filed: Jun. 17, 1991

[51] Int. Cl.[5] ..... H01R 13/66; H01R 23/70

[52] U.S. Cl. ..... 439/76; 439/620; 333/25

[58] Field of Search ..... 333/25, 32; 439/76, 439/620, 63

[56] References Cited

U.S. PATENT DOCUMENTS

| | | | |
|---|---|---|---|
| 3,652,941 | 3/1972 | Neuf | 333/25 |
| 4,717,896 | 1/1988 | Graham | 333/25 |
| 4,800,344 | 1/1989 | Graham | 333/25 |
| 4,846,720 | 7/1989 | Song | 439/407 |
| 5,011,422 | 4/1991 | Yeh | 439/620 |

FOREIGN PATENT DOCUMENTS

| | | | |
|---|---|---|---|
| 117713 | 7/1983 | Japan | 333/32 |

*Primary Examiner*—Gary F. Paumen
*Attorney, Agent, or Firm*—William E. Noonan

[57] ABSTRACT

An electrical connector is provided for selectively attaching an unbalanced data transmission conductor to electronic data processing equipment. The equipment includes a balanced data transmission terminal having a pair of slots and a grounded fitting that is disposed about the slots. The connector includes a base and one or more balanced conductor pins that are mounted to and extend from the base. The pins are inserted into the slots to establish electrical contact with the balanced data transmission conductor. A sleeve-like unthreaded ground conductor element is mounted to and extends from the base and is disposed about the pins. The ground conductor element is slidably engaged in electrical and mechanical contact with the grounded fitting when the pins are inserted into the slots. A jack is mounted to the base and is selectively engaged by a complementary plug formed at one end of the unbalanced data transmission conductor. An RF transformer is interconnected between the pins and the jack for substantially matching the impedance of the pins with that of the unbalanced conductor.

18 Claims, 2 Drawing Sheets

ELECTRICAL CONNECTOR APPARATUS

FIELD OF THE INVENTION

This invention relates to an electrical connector apparatus and, more particularly, to an apparatus for selectively attaching an unbalanced data transmission conductor to conventional electronic data processing equipment.

BACKGROUND OF THE INVENTION

Electrically balanced twin axial cables are widely employed in computer systems for transmitting data back and forth between a host computer and one or more remote terminals. The individual system components are typically interconnected in a daisy chain, star or other known configuration. Popular systems presently featuring balanced data transmission cables include the IBM System 34/36/38 and AS/400 lines.

Conventionally, the balanced data transmission cable is joined to the host or terminal component by a pair of complementary, threaded connector elements that are formed respectively on the system component and one end of the cable. The female connector formed on the computer component includes a pair of slots that accommodate the contacts of the component and a cylindrical, threaded ground conductor that surrounds the slots. The male connector formed at the end of the balanced cable includes a threaded annular collar that is threadably engaged with the ground conductor of the female connector. A pair of balanced conductor pins, attached to the balanced cable, are aligned with the slots in the female connector and received therein when the connector elements are threadably engaged. The male connector also includes a cylindrical ground conductor that engages the inner circumferential surface of the female connector's ground conductor when the male and female connector elements are attached.

The connectors described above exhibit a number of problems. In particular, the balanced data transmission cable is often relatively heavy. Over time, the weight of the cable usually causes it to bend at the connector. Such stress can cause the cable to become loose and detach from the connector pins. As a result, the system is liable to malfunction. Moreover, the threaded male connector found at the end of most balanced data transmission cables is quite bulky. As a result, manipulating and attaching the connector to a computer component can be awkward and time consuming, particularly if the space behind the component is confined or restricted. The conventional balanced transmission cable is also fairly expensive to produce. The connector formed at the end of the cable requires that the threaded collar be manufactured and then assembled with the ground conductor and balanced conductor pins. All of these elements must then be joined permanently at the end of the balanced conductor cable.

Installation is further complicated because the cable does no negotiate bends behind walls or ceilings well. The large size of the male connector requires the electrician to run the cable first and then install the connector.

SUMMARY OF THE INVENTION

It is therefore an object of this invention to provide an improved apparatus for communicably connecting two or more data processing components in a computer system.

It is a further object of this invention to provide an electrical connector apparatus that permits a relatively inexpensive and easily available unbalanced data transmission line, such as a twisted pair telephone line, to be interconnected between two pieces of data processing equipment.

It is a further object of this invention to provide an electrical connector apparatus that permits a pair of data processing components to be effectively interconnected without requiring a heavy twin axial data transmission cable so that cable stress and line failures are reduced.

It is a further object of this invention to provide an electrical connector apparatus that is relatively simple and inexpensive to manufacture.

It is a further object of this invention to provide an electrical connector that allows commonly available telephone style jacks to be used on the electrical interconnecting wire.

It is a further object of this invention to provide an electrical connector apparatus employing a compact, light weight, push-on design that allows the connector to be easily manipulated and attached to electronic data processing equipment, even in a confined area.

It is a further object of this invention to provide an electrical connector that is dependably self-aligning to insure that proper polarity is maintained.

It is a further object of this invention to provide an electrical connector that effectively matches the impedance of an electronic data processing component with an unbalanced data transmission conductor.

It is a further object of this invention to provide a rugged and efficient electrical connector employing a structure that serves both to establish electrical and mechanical contact and to protect the connector pins and other electrical components of the connector.

This invention results from a realization that data may be transmitted between a pair of electronic data processing components much more efficiently and with much less chance of line stress and failure by employing an unbalanced data transmission conductor, such as a twisted pair telephone line, between the electronic components This invention results from the further realization that such an unbalanced conductor may be effectively utilized by employing an electrical connector which includes structure that substantially matches the impedance of the data processing equipment to that of the unbalanced data transmission line.

Accordingly, this invention features an electrical connector for selectively attaching an unbalanced data transmission conductor to electronic data processing equipment, which equipment includes a balanced data transmission terminal having slot means and a grounded fitting that is disposed about the slot means. The connector includes a base and balanced conductor insertion means that are mounted to and extend from the base. The balanced conductor insertion means are selectively inserted into the slot means to establish electrical contact with the balanced data transmission terminal. An unthreaded ground conductor is attached to and extends from the base and is disposed about the insertion means. The ground conductor element is slidably engaged in electrical and mechanical contact with the grounded fitting when the insertion means are inserted into the slot means. First attachment means, mounted to the base, are selectively engaged by complementary second attachment means formed at one end of the unbalanced data transmission conductor for establishing electrical interconnection with the unbalanced data transmission conductor. There are means, electrically interconnected between the insertion means and the first attachment means for substantially matching the impedance of the balanced conductor insertion means with that of the unbalanced conductor.

In a preferred embodiment, the insertion means include a pair of electrically conductive pins and the slot mean include a complementary pair of slots, each of which receives a respective pin to establish electrical interconnection between the pins and the balanced terminal. The ground conductor may include a sleevelike element that extends from the base in the same general direction as the insertion means. The ground conductor element preferably extends beyond the distal end of the insertion means and has a generally cylindrical shape. The grounded fitting may include a generally cylindrical shape and the ground conductor element may have an outer diameter that is at least as great as the inside diameter of the grounded fitting. The ground conductor element may further include spring means that allow the ground conductor element to be radially contracted t fit longitudinally within the grounded fitting wherein the spring means urge the outer diameter surface of the ground conductor element into contact with the inside diameter surface of the grounded fitting.

The means for substantially matching may include means for transforming the impedance of the balanced conductor insertion means to substantially match the impedance of the unbalanced conductor. Such means for transforming may include an RF transformer.

The grounded fitting may include an alignment detent formed on the inside diameter surface thereof and the ground conductor element may include a complementary recess that is engaged with the detent when the ground conductor element is fit within the grounded fitting to maintain the radial orientation of the ground conductor element in the grounded fitting.

The base may include a metal-clad upper surface that is insulated from the balanced conductor insertion means and connected to the ground conductor elements. A potting compound may be used to secure the ground conductor element to the base.

A housing may be formed about the base between the ground conductor element and a first attachment means. That housing may include a generally tubular element, such as a heat-shrinkable casing. Preferably, the first attachment means include a jack and the second attachment means include a plug member. The jack and plug member are typically of the type used for connecting unbalanced data transmission lines, such as twisted pair telephone lines.

DETAILED DESCRIPTION OF PREFERRED EMBODIMENT

Other objects, features and advantages will occur from the following description of a preferred embodiment and the accompanying drawings in which.

Figure 1:
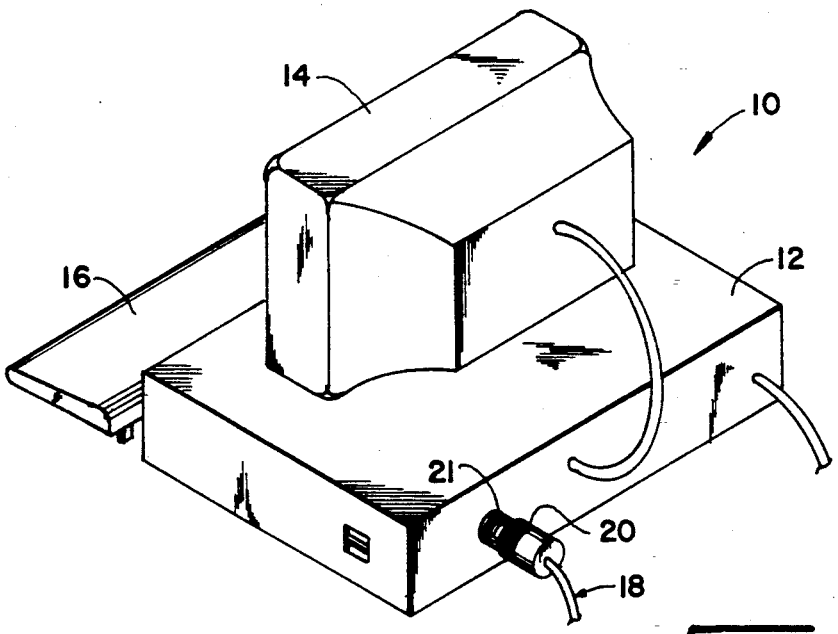
Fig. 1 PRIOR ART
FIG. 1 is a perspective view of a remote data processing terminal that employs a conventional balanced twin axial cable for transmitting data to a host component or other terminal, as is known in the prior art.

There is shown in FIG. 1 a conventional piece of data processing equipment 10, which comprises an individual component, such as the host computer or a remote terminal, of a computer system. Examples of systems that utilize such components are the IBM System 34/36/38 and AS/400 lines. It should be understood however that this equipment may be found in a wide variety of alternative systems.

Equipment 10 includes a CPU 12, a display 14 and a keyboard 16. CPU 12 is joined to the host computer or terminals at one or more remote stations by a conventional balanced twin axial data transmission cable 18. This cable terminates in a conventional threaded male connector 20 that engages a complementary terminal of threaded female connector element 21 formed in the rear of CPU 12. The threaded female connector is itself joined to and forms the terminal end of a conventional balanced data transmission conductor disposed within CPU 12. As a result, the balanced conductor 18 is connected to the balanced conductor of the CPU so that digital data signals may be transmitted to and from equipment 10.

Unfortunately, as shown in FIG. 1, cable 18 is relatively bulky and heavy. As a result, it tends to sag or bend proximate connector 20. This can cause cable 18 to become loosened from the pins carried by connector 20. Eventually, this can interfere with the effective transmission of data through the cable. Moreover, threaded connector 20 tends to be difficult to manipulate and attach to female connector 21, particularly in restricted or confined areas behind the equipment.

Figure 2:
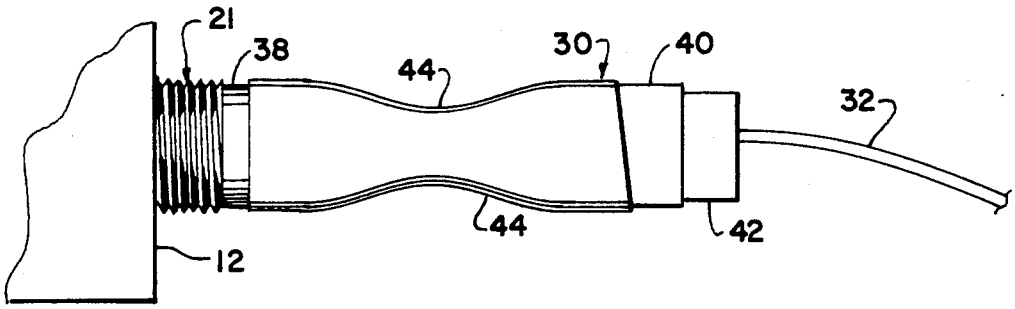
FIG. 2 is an elevational side view of the electrical connector of this invention, operably engaged with the conventional female connector of a data processing component.
Figure 3:
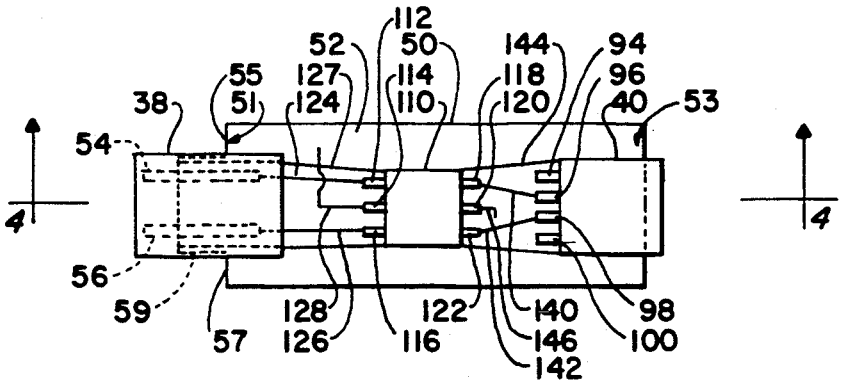
FIG. 3 is a plan view of the electrical connector with the housing removed to illustrate the internal components of the apparatus.
Figure 5:
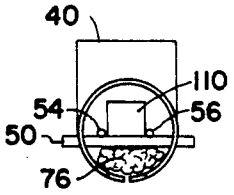
FIG. 5 is a elevational front end view of the electrical connector.

An improved electrical connector 30, in accordance with this invention, is illustrated in FIG. 2. Connector 30 is attached at one end of an unbalanced data transmission conductor 32, which typically comprises a conventional twisted pair telephone line. The connector 30 is electrically and mechanically engaged at its opposite end with threaded female CPU connector 21 so that data may be transmitted to and from CPU 12 through unbalanced conductor 32. More particularly, connector 30 includes an unthreaded, sleeve-like ground conductor 38 that is slidably engaged with connector 21 in a manner described more fully below. The opposite end of connector 30 includes a conventional telephone line jack 40 that receives a complementary standard telephone line plug 42 formed at the end of unbalanced conductor 32. A heat shrink housing 44 is formed between ground conductor 38 and jack 40 to enclose and protect the internal components of connector 30. The details of connector 30 are illustrated more clearly in FIGS. 3-10. A planar, generally rectangular circuit board 50 having a copper clad upper surface 52 forms a base for supporting the electrical components of the connector. Board 50 includes a forward end 51 and a rearward end 53. A pair of notches 55 and 57 are formed in the corners of forward end 51. A reduced width portion 59, best shown in FIGS. 3 and 10, is formed between notches 55 and 57. Balanced conductor insertion means, that include a pair of balanced conductor pins 54 and 56, are soldered or otherwise permanently attached to the forward end of base 50 such that they extend forwardly from the base. Ground conductor sleeve 38 includes a generally cylindrical element that is likewise attached to the board 50 such that it extends from forward end 51. More particularly, element 38 generally surrounds and extends beyond the distal ends of pins 54 and 56.

Figure 7:
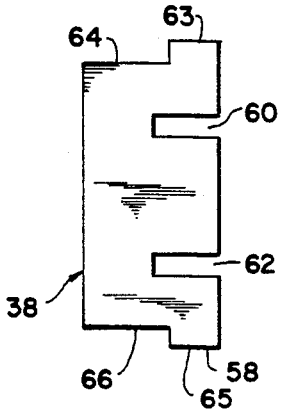
FIG. 7 is a plan view of a flat piece of metal that is used to form the ground conductor sleeve.
Figure 8:
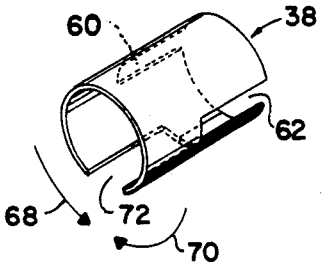
FIG. 8 is a perspective view of the ground conductor sleeve.

Sleeve 38 is constructed in the manner shown in FIGS. 7 and 8. Initially, the sleeve is composed of a piece of generally flat metal stock 58, FIG. 7, which may include brass, phosphor bronze or another suitable metal or metallic alloy. The material should be somewhat resilient, constitute a suitable electrical conductor and resist corrosion. Metal stock 58 preferably has a thickness of approximately .03 inches, although various other thicknesses may be employed within the scope of this invention. A pair of parallel slots 60 and 62 are formed in one end of stock 58. A pair of notches 64 and 66 are formed along the sides 63 and 65 of stock 58 such that they extend from the opposite end thereof. After the metal stock is cut to an appropriate size and the slots and notches are formed, the stock is rolled in the direction of arrows 68 and 70, FIG. 8, such that side edges 63 and 65 are brought in close proximity to one another. As a result, generally cylindrical sleeve 38 is formed. Notches 64 and 66 combine to form a recess 72 that extends inwardly from one end of sleeve 38. Recess 72 serves to properly align the connector when it is attached to the data processing equipment, as described more fully below. Slots 60 and 62 extend longitudinally from the opposite end of sleeve 38 and are separated from one another by approximately 180 degrees.

Figure 9:
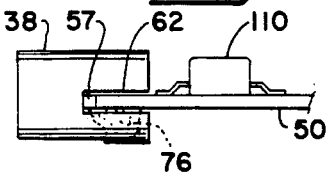
FIG. 9 is an elevational, side view of the forward end of the connector with the enclosure removed to illustrate the interconnection between the ground conductor sleeve and the base.
Figure 10:
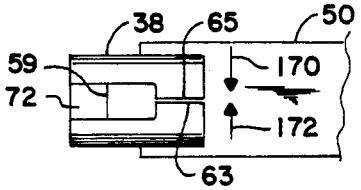
FIG. 10 is a bottom view of the forward end of the connector with the enclosure removed.

Sleeve 38 is mounted to board 50, as shown in FIGS. 3-6, 9 and 10. In particular, slots 60 and 62 engage notches 55 and 57, respectively, and receive the board as shown in FIG. 9. As a result, the reduced width portion 59 of board 50 is accommodated within the cylindrical sleeve 38, as shown in FIGS. 3 and 10. Sleeve 38 contacts copper layer 52 on board 50 so that the sleeve is grounded t the board. Sleeve element 38 is then secured to the base by an appropriate potting compound 76, shown in FIGS. 5 and 9 and soldered to the copper layer 52 to provide a good electrical connection.

Figure 4:
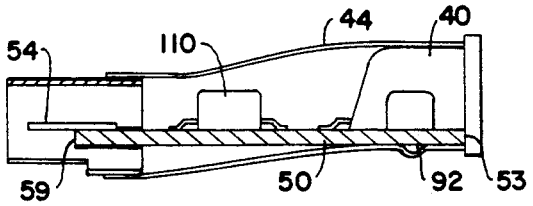
FIG. 4 is an elevational, cross-sectional view of the electrical connector, including the housing, taken along line 4—4 of FIG. 3.
Figure 6:
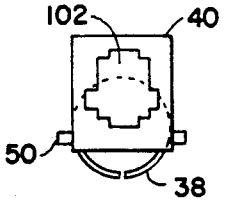
FIG. 6 is an elevational rear end view of the connector.

Means are formed at rearward end 53 of board 50 for selectively attaching connector 30 to one end of an unbalanced data transmission line. Such means include a first attachment element comprising the modular telephone jack 40, FIGS. 3, 4, 5 and 6, that is secured to board 50 at the rearward end 53 thereof by a pair of clips 92, only one of which is shown in FIG. 4. Clips 92 extend through complementary holes in board 50 and engage the board to securely mount jack 90 to the upper surface thereof. Jack 90 may comprise an RJ-11 jack, such as is manufactured under the designation AMP #555-077-2. Various alternative attachment elements may also be utilized. As best shown in FIG. 3, jack 90 includes four terminals 94, 96, 98 and 100 that extend from the forward end thereof. The rearward end of the jack includes a conventionally shaped receptacle 102, best shown in FIG. 6, for receiving a complementary attachment element, such as the conventional plug 42, FIG. 2, formed at the end of the twisted pair telephone wire 32.

As best shown in FIGS. 3 and 4, an RF transformer 110 is interconnected between, on the one hand, pins 54 and 56 and element 38 and, on the other hand, jack 90. In particular, transformer 110 may comprise an RF transformer such as the Mini Circuits Model T1-1T. Various other types of transformers may also be utilized. Transformer 110 includes three forward pins or terminals 112, 114, and 116 and three rearwardly extending pins or terminals 118, 120 and 122. As best shown in FIG. 3, balanced pins 54 and 56 are attached to transformer terminals 112 and 116 by respective wires 124 and 126. These wires extend along an insulated path 127 on board 50, from which path the upper copper layer 52 is removed. A wire 128 interconnects forward transformer terminal 114 to the copper layer 52 and thereby to the grounded conductor sleeve 38, which is connected to copper layer 52. Rearward transformer terminals 118 and 122 are connected to central terminals 96 and 9 of jack 90 by respective wires 140 and 142. Once again, these wires extend along an insulated path 144 that is formed along the upper surface of board 50 by removing a section of the copper from layer 52. Transformer terminal 120 is attached to the insulated path 144 by a lead 146. That terminal is not electrically connected to any other element.

Transformer 110 matches the impedance of the balanced pins 54 and 56 with the impedance of the unbalanced telephone line that is selectively connected to jack 90. For example, the balanced conductor pins may require an impedance of approximately 50 ohms to operate properly with the data processing equipment. On the other hand, a typical twisted pair unbalanced telephone line has an impedance of 120 ohms. Transformer 110 matches these impedances by transforming the impedance of the balanced conductor pins to that of the unbalanced conductor. This permits a digital data signal to be transmitted smoothly between the electronic data processing equipment and the telephone line.

Housing 44, FIGS. 2 and 4, encloses and protects the internal components of connector 30. Housing 44 is formed by disposing a generally tubular element about board 50. The tubular element extends generally from the grounded conductor sleeve 38 to the jack 40. The housing may be composed of a heat shrinkable plastic material. The material is heated so that it shrinks and the ends of the tube firmly engage sleeve 38 and jack 40, respectively.

Figure 11:
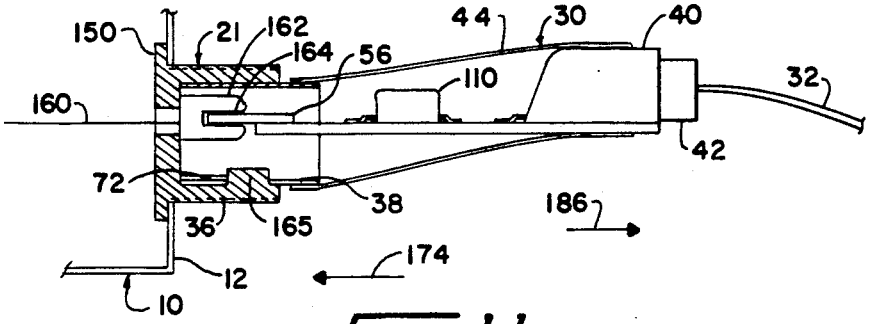
FIG. 11 is an elevational, cross-sectional view of the connectors engaged as in FIG. 2.

As shown in FIG. 11, female connector 21 includes a bushing 150 that is secured within the housing of CPU 12. Connector 21 also includes a cylindrical grounded fitting 36 having external threads. Fitting 36 extends outwardly from bushing 150 through the wall of CPU 12. A pair of balanced conductors 160, only one of which is shown, extend axially centrally through connector 21 and, more particularly, through a central insulating element 162 that is formed within grounded fitting 36. Element 162 includes a pair of balanced conductor slots 164, only one of which is shown. Each of the slots 164 is electrically connected to a respective one of the pair of balanced conductors 160. A detent 165 is formed on the inside circumferential wall of grounded fitting 36. This detent is employed for properly aligning the electrical connectors 21 and 30 with slots 164, as is described more fully below.

Connector element 30 is selectively attached with female connector element 21 in the manner shown in FIGS. 2 and 11. In particular, connector element 30 is manipulated so that its recess 72, best shown in FIGS. 8 and 10, is generally aligned with alignment detent 165 in fitting 36. Normally, prior to insertion, the grounded conductor sleeve 38 has an outside diameter that is at least as large as the inside diameter of grounded fitting 36. Because ground conductor sleeve 38 is composed of a resilient metal, it may be contracted slightly in diameter so that the connector elements 21 and 30 may be fitted together. To accomplish this, the sleeve 38 is contracted by pushing together edges 63 and 65, FIG. 10, as indicated by arrows 170 and 172. Sleeve 38 is then slidably inserted in the direction of arrow 174, FIG. 11, into grounded fitting 36. The resilience of sleeve 38 urges it into snug mechanical contact with grounded fitting 36. At the same time, pins 54 and 56 are received in respective slots 164 formed in the insulating element 162. As a result, electrical and mechanical contact is established between connectors 21 and 30. It should be noted that such connection is made only when the recess 72 and the detent 165 are properly aligned. If they are not so aligned, the connector element 30 cannot be secured to the connector element 21. As a result, the balanced pins 54 and 56 cannot be inserted into the incorrect slots and proper polarity is maintained. Because sleeve 38 extends beyond pins 54 and 56, the fragile pins are protected both before and during engagement of connectors 21 and 30. Unintended bending and misalignment of the pins is reduced and electrical interconnection is enhanced.

When connector element 30 is engaged in the above manner with connector element 21, unbalanced data transmission line 32 is electrically joined to the data processing equipment 10. As a result, digital data signals may be transmitted back and forth between equipment 10 and either a host or remote terminal at the opposite end of conductor 32. For example, digital signals that are generated in CPU 12 are transmitted over balanced conductor wires 160 to conductor slots 164 of female connector element 21 From there, the signals are transmitted to balanced pins 54 and 56. The impedance of the balanced pins is transformed by RF transformer 110 to match the impedance of the unbalanced conductor 32. As a result, the signals are smoothly transmitted over conductor 32 to data processing equipment at the remote location.

Connector element 30 is easily disengaged from connector 2 by grasping the connector element and pulling it in the direction of arrow 186. Grounded conductor sleeve 38 slides out of grounded fitting 36 and pins 54 and 56 slide out of their respective slots 164. When connector 30 is disengaged from the connector element 21, the cylindrical grounded conductor sleeve 38 resiliently expands to regain its original size wherein its outer diameter is at least as great as the inner diameter of the grounded fitting 36. Conductor 32 may be selectively disconnected from and reconnected to with connector element 30 by respectively removing plug 42 from and reinserting the plug into jack 40.

Connector 30 permits a relatively inexpensive, commonly available unbalanced data transmission line, such as twisted telephone wire 32 to be employed to transmit data. Such a lightweight unbalanced conductor does not exhibit the mechanical stress inherent in the relatively heavy and bulky balanced conductors that are presently utilized in computer systems. As a result, costly and time consuming system failures are avoided. It is also much less costly to replace than is conventional twin axial cable. Moreover, such lightweight, unbalanced lines are often easier to manipulate in the confined space that is typically found behind data processing terminals. And unlike conventional twin axial cable connectors, connector element 30 is attached and removed using a very simple sliding operation. It does not require the threading and manipulation that is required when conventional threaded connectors are utilized.

The connector 30 itself is relatively easily and inexpensively produced. If the connector fails it can be readily and inexpensively replaced by another connector without having to replace the entire data transmission conductor.

Although specific features of the invention are shown in some of the drawings and not others, this is for convenience only as each feature may be combined with any an all other features in accordance with this invention.

Other embodiments will occur to those skilled in the art and are within the following claims.

What is claimed is:

1. An electrical connector for selectively attaching an unbalanced data transmission conductor to electronic data processing equipment, which equipment includes a balanced data transmission terminal having slot means and a grounded fitting that is disposed about said slot means, said connector comprising:

a base;

balanced conductor insertion means mounted to and extending from said base and being selectively inserted into said slot means to establish electrical contact with said balanced data transmission terminal;

an unthreaded ground conductor element attached to and extending from said base and being disposed about said insertion means; said ground conductor element being slidably engaged in electrical and mechanical contact with said grounded fitting when said insertion means are inserted into said slot means;

first attachment means mounted to said base and being selectively engaged by complementary second attachment means formed at one end of said unbalanced data transmission conductor for establishing electrical interconnection with said unbalanced data transmission conductor; and means, electrically interconnected between said insertion means and said first attachment means, for substantially matching the impedance of said balanced conductor insertion means with that of said unbalanced conductor;

said base including a conductive region that is insulated from said balanced conductor insertion means and interconnected between said ground conductor element and said means for substantially matching the impedance.

2. The connector of claim 1 in which said insertion means include a pair of electrically conductive pins and said slot means include a complementary pair of slots, each said slot receiving a respective one of said pins to establish electrical contact between said pins and said balanced terminal.

3. The connector of claim 1 in which said ground conductor element includes a sleeve-like element that extends from said base in the same general direction as said insertion means.

4. The connector of claim 3 in which said ground conductor element extends beyond a distal end of said insertion means.

5. The connector of claim 3 in which said ground conductor element includes a generally cylindrical shape.

6. The connector of claim 5 in which said grounded fitting is generally cylindrical and said ground conductor element includes an outer diameter that is at least as great as an inside diameter of said grounded fitting, said ground conductor element further including spring means that allow said ground conductor element to be radially contracted to fit longitudinally slidably within said grounded fitting, wherein said spring means urge the outer diameter surface of said ground conductor element into contact with the inside diameter surface of said grounded fitting.

7. The connector of claim 1 in which said ground conductor element includes spring means that allow said ground conductor to be slidably engaged with and disengaged from said grounded fitting and that urge said ground conductor element into electrical and mechanical contact with said grounded fitting when said ground conductor element and said grounded fitting are engaged.

8. The connector of claim 1 in which said means for substantially matching include means for transforming the impedance of said balanced conductor insertion means to substantially match the impedance of said unbalanced conductor.

9. The connector of claim 8 in which said means for transforming include an RF transformer.

10. The connector of claim 5 in which said grounded fitting includes an alignment detent formed on the inside diameter surface thereof and said ground conductor element includes a complementary recess that is engageable with said detent to permit said ground conductor element to fit within said grounded fitting and said insertion means to fit in said slot means only when said detent and said recess are generally aligned.

11. The connector of claim 1 in which said conductive region is a metallic upper surface on said base.

12. The connector of claim 1 in which a potting material secures said ground conductor element to said base.

13. The connector of claim 1 further including a housing formed about said base between said ground conductor element and said first attachment means.

14. The connector of claim 13 in which said housing includes a generally tubular material.

15. The connector of claim 14 in which said housing includes a heat shrinkable material.

16. The connector of claim in which said first attachment means includes a jack member and said second attachment means includes a plug member.

17. An electrical connector for selectively attaching an unbalanced data transmission conductor to electronic data processing equipment, which equipment includes a balanced data transmission terminal having slot means and a grounded fitting that is disposed about said slot means, said connector comprising:

a base;

balanced conductor insertion means mounted to and extending from said base and selectively inserted into said slot means to establish electrical contact with said balanced data transmission terminal;

a sleeve-like unthreaded ground conductor element mounted to and extending from said base and being disposed about said insertion means, said ground conductor element being slidably engaged in electrical and mechanical contact with said grounded fitting when said insertion means are inserted into said slot means; said grounded fitting being generally cylindrical and said ground conductor element including an outer diameter that is at least as great as an inside diameter of said grounded fitting, said ground conductor element further including spring means that allow said ground conductor element to be radially contracted to fit longitudinally slidably within said ground fitting, wherein said spring means urge the outer diameter surface of said ground conductor element into contact with the inside diameter surface of said grounded fitting;

a jack mounted to said base and being selectively engaged by a complementary plug formed at one end of said unbalanced data transmission conductor; and means, electrically interconnected between said insertion means and said jack, for substantially matching the impedance of said balanced conductor insertion means with that of said unbalanced conductor.

18. An electrical connector for selectively attaching an unbalanced data transmission conductor to electronic data processing equipment, which equipment includes a balanced data transmission terminal having slt means and a grounded fitting that is disposed about said slot means, said connector comprising:

a base;

balanced conductor insertion means mounted to and extending from said base and selectively inserted into said slot means to establish electrical contact with said balanced data transmission terminal, said insertion means including a pair of electrically conductive pins and said slot means including a complementary pair of slots, each said slot receiving a respective one of said pins to establish electrical contact between said pins and said balanced terminal;

an unthreaded ground conductor element attached to and extending from said base and being disposed about said insertion means; said ground conductor element being slidably engaged in electrical and mechanical contact with said grounded fitting when said insertion means are inserted into said slot means;

first attachment means mounted to said base and being selectively engaged by complementary second attachment means formed at one end of said unbalanced data transmission conductor for establishing electrical interconnection with said unbalanced data transmission conductor; and means, electrically interconnected between said insertion means and said first attachment means, for substantially matching the impedance of said balanced conductor insertion means with that of said unbalanced conductor.

* * * * *

UNITED STATES PATENT AND TRADEMARK OFFICE

CERTIFICATE OF CORRECTION

PATENT NO. : 5,133,668

DATED : Jul. 28, 1992

INVENTOR(S) : David C. Brown, IV

It is certified that error appears in the above-identified patent and that said Letters Patent is hereby corrected as shown below:

Column 1, line 61, change "no" to -- not --;

column 3, line 11, change "mean" to -- means --;

line 25, change "t fit" to -- to fit --;

column 5, lines 66 and 67 and column 6, lines 12, 28 and 38, change each occurrence of "jack 90" to -- jack 40 --;

column 6, line 28, change "9" to -- 98 --;

column 7, line 57, change "2" to -- 21 --;

line 66, after "to" delete "with";

column 8, line 27, change "an" to -- and --;

column 9, claim 16, line 61, after "claim" insert -- 1 --;

column 10, claim 18, line 37, change "slt" to -- slot --.

Signed and Sealed this

Twenty-third Day of November, 1993

*Attest:*

Bruce Lehman

BRUCE LEHMAN

*Attesting Officer*

*Commissioner of Patents and Trademarks*